US006516988B2

(12) United States Patent
Bergeron et al.

(10) Patent No.: US 6,516,988 B2
(45) Date of Patent: Feb. 11, 2003

(54) CONNECTOR INSERTION TOOL

(75) Inventors: George Leo Bergeron, Springfield, VA (US); Steven Patrick Wallace, Arlington, VA (US); Jon Harrison Ward, Reston, VA (US)

(73) Assignee: Science Applications International Corporation, San Diego, CA (US)

( * ) Notice: Subject to any disclaimer, the term of this patent is extended or adjusted under 35 U.S.C. 154(b) by 0 day.

(21) Appl. No.: 09/836,754

(22) Filed: Apr. 17, 2001

(65) Prior Publication Data

US 2002/0148877 A1 Oct. 17, 2002

(51) Int. Cl.[7] ..... B25C 3/00

(52) U.S. Cl. ..... 227/85; 227/108; 227/143; 227/148; 227/155

(58) Field of Search ..... 227/85, 108, 143, 227/148, 155, 153; 29/525.01

(56) References Cited

U.S. PATENT DOCUMENTS 2,987,725 A * 6/1961 Heilman ..... 227/108
2,989,948 A * 6/1961 Forrester ..... 173/169
3,313,463 A * 4/1967 Boucher ..... 227/108
4,643,263 A * 2/1987 Karden ..... 173/168
5,466,087 A * 11/1995 Doole ..... 403/230

* cited by examiner

*Primary Examiner*—Scott A. Smith
*Assistant Examiner*—Nathaniel Chukwurah
(74) *Attorney, Agent, or Firm*—Kilpatrick Stockton LLP

(57) ABSTRACT

A connector insertion tool includes a pneumatic drive mechanism for connecting two structural members through the use of connectors having two spiked ends oriented in different planes relative to each other. A first pneumatic mechanism rotates a first spiked end of a pair of connectors into a position for being driven into a structural member. A pneumatic mechanism drives a block which engaged and drives the spiked ends into a first structural member, and positions the second spiked end of each connector into position for being driven into a second structural member. A pair of clamp arms rotate into position through the operation of the pneumatic drive mechanism causing a connector to be driven into opposite sides of a second structural member for connecting the first and second structural members, for example, beams in wood-frame construction, together.

32 Claims, 7 Drawing Sheets

CONNECTOR INSERTION TOOL

BACKGROUND OF THE INVENTION

1. Field of the Invention

This invention relates to a connector insertion tool for connecting two structural members, particularly, posts, beams, timbers or like structures used in frame construction such as wood frame construction. The connector insertion tool is for connecting such structural members with connectors having a cranked stem and a spike at each end.

2. Background of the Invention

Current commercial wood frame construction requires that nailing is accomplished with powered nailers, typically pneumatic nailers, which results in a much faster operation than by nailing by hand with a hammer. Typically, such nailers repeatedly drive nails one at a time into the material to be nailed. A piston assembly in a cylindrical assembly supports a driver blade. A plurality of air chambers, poppet assemblies and trigger valve mechanisms are arranged to actuate a valve plunger to drive nails with the driver blade in such devices.

As an alternative to conventional nails driven by powered nailers, a different type of nail connector has been developed which includes a pair of spikes disposed at the ends of a cranked stem. The spikes may be positioned in vertical planes and extend angularly to one another such that the connector may be used for interconnecting respective faces of adjacent timber or structural members which are perpendicular to one another. Examples of such nail connectors are disclosed in detail in U.S. Pat. No. 5,466,087.

The spikes typically form acute angles with the portions of the stem adjacent thereto, with one spike tapering away from the axis of the other spike towards its outer end such that the structural members with which they are used are drawn together during rotation of the stem portion about the primary strike as the second spike is driven home. It will be appreciated that while the term "structural member" is used herein, it is used to refer interchangeably with such terms as "posts," "planks," "timbers" and/or "beams," or other like structures, for example, for use in frame construction. When such connectors are used, the structural members are connected to each other through the use of such connectors as is further described herein.

A problem with the type of connector described, however, is that since in commercial wood frame construction most nailing is accomplished with powered nailers and conventional nails, there is no tool readily available which can be used with the cranked type of connectors having two spiked ends, because of the complex connector geometry.

More specifically, existing powered nailers for driving conventional straight nails may accomplish their intended functions, but not in a manner capable of being used with the cranked type of connectors disclosed. Many existing prior art nailers include subsystems for holding straight nails in either a planar or coiled configuration, and feeding the straight nails into a position ready for driving. However, due to the configuration of the cranked connectors previously described, it is readily apparent that such connectors cannot be held in or fed through the use of existing nailers.

Accordingly, in accordance with the device described herein, the problems with the prior art powered nailers are avoided, and a nailer or connector insertion tool is described which can be used with the cranked connectors, so as to avoid, among others, the disadvantages of nailing the cranked type of connector manually.

SUMMARY OF THE INVENTION

In accordance with one aspect of the invention, there is provided a connector insertion tool for connecting two structural members to each other, for use with connectors having a cranked stem and a spike at each end. The two structural members, as previously noted, can be timbers, beams, posts and/or planks, or other like structures, and can be in various arrangements or configurations relative to each other. For example, they can be arranged abutting each other in a perpendicular arrangement.

The connector insertion tool includes a first positioning holder for supporting a first spiked end of a connector of the type having a cranked stem, and first and second spiked ends, in a first position in which the first spiked end is not in a position to be driven into the first member. The first positioning holder is movable to a second position in which the first spiked end is positioned for being driven into the first structural member. A first drive member is movable from a first position to a second position for contacting and driving the first spiked end into the first structural member when the first spiked end is positioned for being driven into the first structural member. After the first spiked end is driven into the first structural member, the second spiked end is rotated into a position for being driven into the second structural member. A second drive member is movable from a first position to a second position for contacting and driving the second spiked end into the second structural member when the second spiked end is position for being driven into the second structural member. A drive mechanism serves to move the first drive member between the first and second position, and for moving the second drive member between the first and second position, whereby when the first spiked end is driven into the first structural member and the second spiked end is driven into the second structural member, the structural members are secured together.

In a more specific aspect, there is a second positioning holder provided disposed substantially parallel to the first positioning holder for supporting a first spiked end of another connector of the type having a cranked stem and first and second spiked ends, a first position in which the first spiked end is not in position for being driven into the first structural member, and the second positioning holder is movable to a second position in which the first spiked end is positioned in position for being driven into the first structural member on a side of the tool opposite the connector supported by the first positioning holder, and due to the shape of the connectors, with the respective first spiked ends offset relative to each other to avoid interference when driven into the first structural member.

Preferably, the connector insertion tool includes a grip and trigger assembly for allowing positioning of the tool for driving the connectors into the first and second structural members, and for actuating the driving of the connectors into the first and second structural members.

Preferably also, the grip and trigger are part of a handle assembly that includes a rotatable joint. This joint allows the tool to be operated in at least two different orientations, to make the tool easier and more comfortable to use.

In a more specific aspect, the drive mechanism is a piston assembly having drive rods for driving the first and second drive members into the second position. The positioning holders are made up of swing arms rotatably pinned through a vertical axis which is fixed relative to the tool, and with a spring connected to each swing arm to urge each swing arm into its first position. Vertically extending bosses serve to contact the swing arms and rotate the swing arms into the second position as the drive rods drive the first and second drive members.

As previously discussed, the structural members which are secured together by the connectors can be beams, planks or timbers, or like structures, which are secured together in substantially perpendicular position relative to the other.

As a result of the previously described arrangement, in one aspect the connector insertion tool allows the driving of two connectors simultaneously to effect a connection between a first structural member and a second structural member. In a more specific aspect, the second structural member is perpendicular to and abutted against the first structural member, and the first spike of each connector is driven in a direction perpendicular to that of the second spike. The tool is assembled for driving the first and second spikes of each connector sequentially and to hold a supply of the connectors in a compact configuration. Each connector is fed in turn from its stored position into a position from which it can be accurately and reliably driven into the structural members. In a more typical arrangement, the drive rods are driven by a piston assembly, typically a pneumatic piston assembly, although other types of drive arrangements, such as an electrical reciprocating motor or similar arrangements as will be readily apparent to those of ordinary skill in the art, can be employed.

DESCRIPTION OF THE DRAWINGS

Having thus briefly described the invention, the same will become better understood from the appended drawings in which.

DETAILED DISCUSSION OF THE INVENTION

Figure 1:
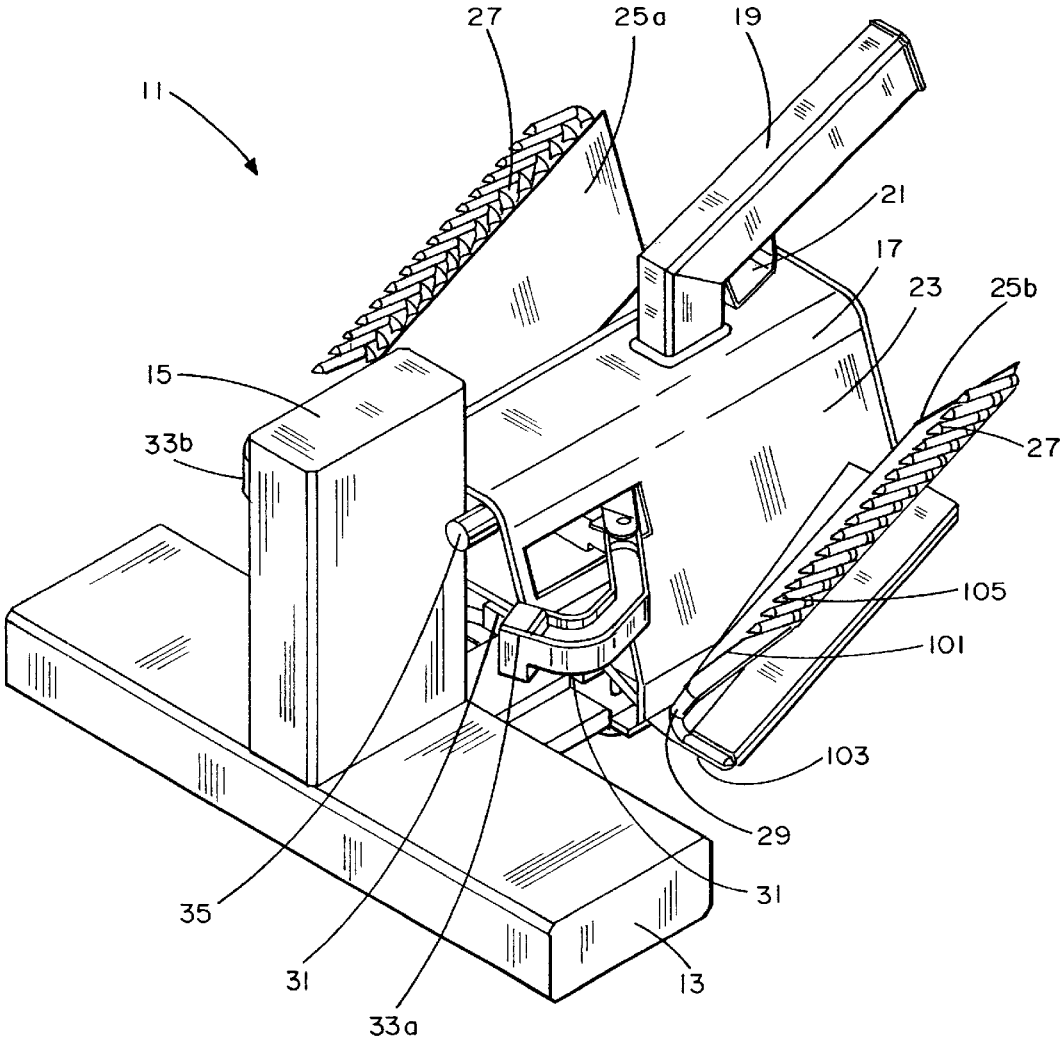
FIG. 1 is a perspective view of the insertion tool described hereinafter.

FIG. 1 shows in perspective view the connector insertion tool 11 disclosed herein. The tool 11 includes a main body 17 having sidewalls 23 and is used to secure two structural members 13 and 15, such as timbers, posts, planks or beams of the type typically used in frame construction, for example, wood frame construction. The tool 11 is used to connect the two structural members 13 and 15 together through the use of connectors 27 which have a cranked stem 101 and a pair of spikes 103 and 105 disposed at the ends of the cranked stem 101. Examples of such connectors are, as previously noted, disclosed in U.S. Pat. No. 5,466,087.

The tool 11 includes connector holding trays 25*a* an d 25*b* supported along each side 23 of the tool 11 for holding a plurality of connectors 27 slidably disposed therein. The connector holding trays 25*a* and 25*b* are made up of upper plates 43 and lower plates 45 shown in FIG. 2 spaced from each other to define guide rails in a manner such that the connectors 27 can be securely but slidably held therein.

Each connector, as shown in FIG. 1, includes a cranked stem 101, first spiked end 103, and second spiked end 105. The tool 11 also includes a pair of pins 35 as is more clearly shown in FIGS. 1, 2, 4 and 5 for supporting the second structural member 15 relative to the first structural member 13 and to the tool 11, to allow the connectors 27 to be driven into both structural members 13 and 15 through the use of the tool 11.

Figure 7:
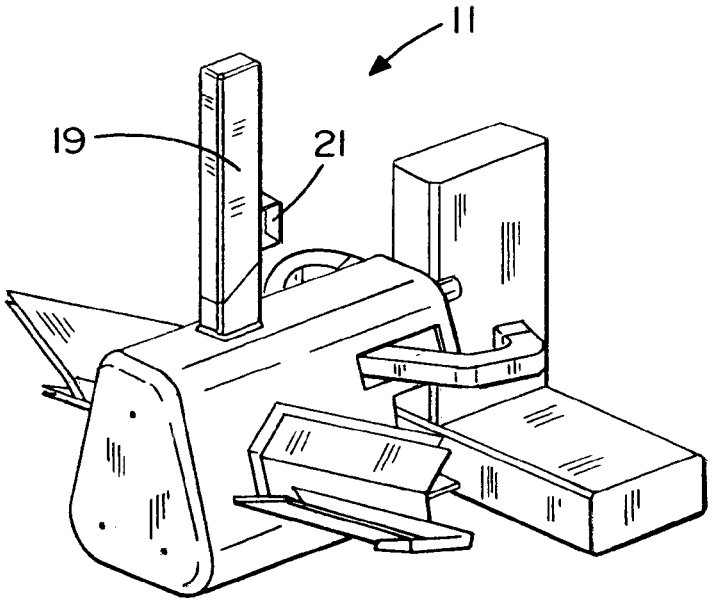
FIG. 7 is a perspective view of the tool with the handle disposed in one position.
Figure 8:
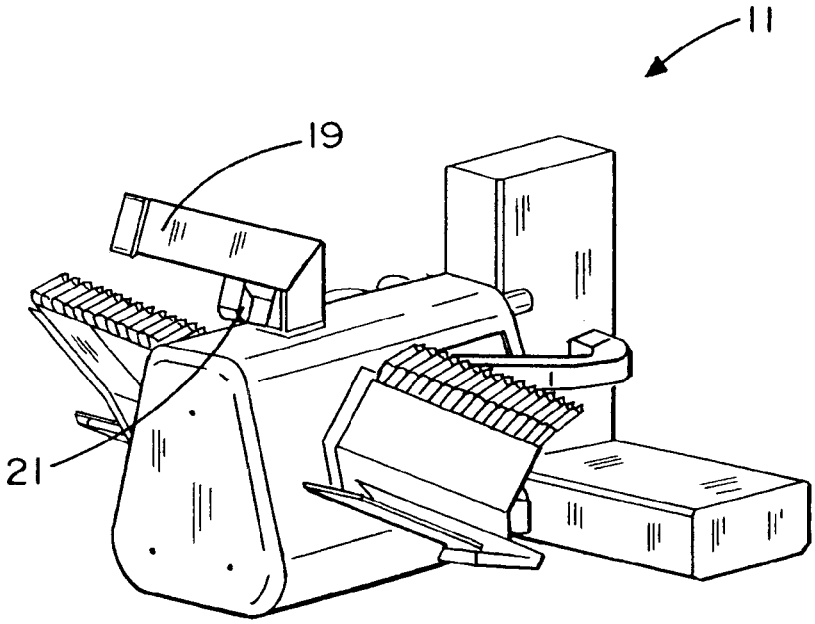
FIG. 8 is a perspective view of the tool with the handle disposed in a different position from that of FIG. 7.

To facilitate holding the tool 11, a handle 19 which is rotatable, is provided, and includes a handle stem grip and a trigger 21 which serves to actuate the operating mechanisms of the tool 11 as will be described further hereafter. As shown in FIGS. 7 and 8, the handle 19 extends a convenient distance from the tool body 17. The handle 19 is connected to the tool body 17 by a rotatable joint with the trigger 21 fixed relative to the handle 19. The joint allows the tool 11 to be reoriented relative to a user for ergonomically comfortable installation of structural members, whether the structural member is above or below the tool from the user's perspective. FIG. 7 shows the handle 19 in one orientation and FIG. 8 shows the handle 19 in another orientation.

Figure 2:
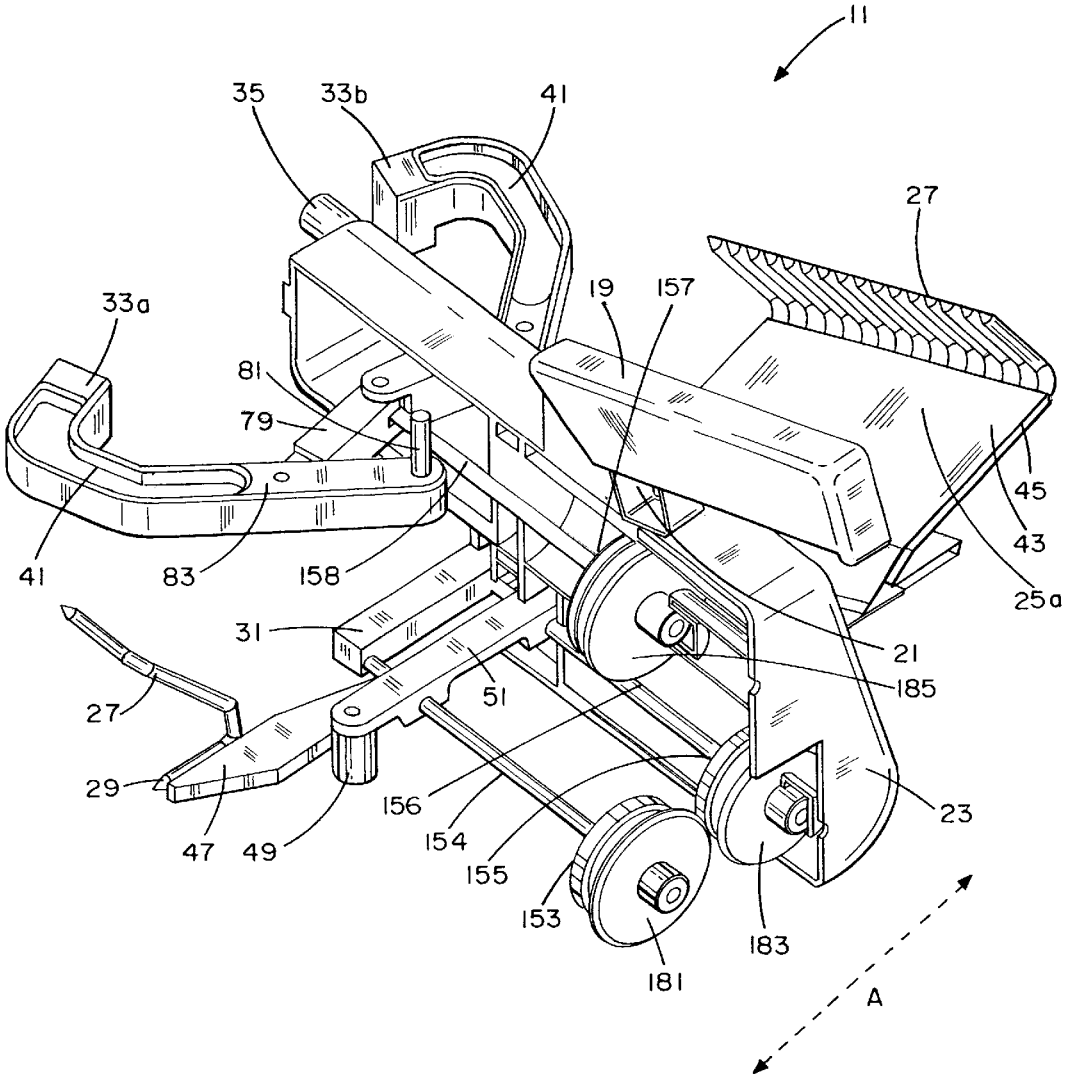
FIG. 2 is a perspective partial cutaway view showing the various elements of the insertion tool of FIG. 1.
Figure 3:
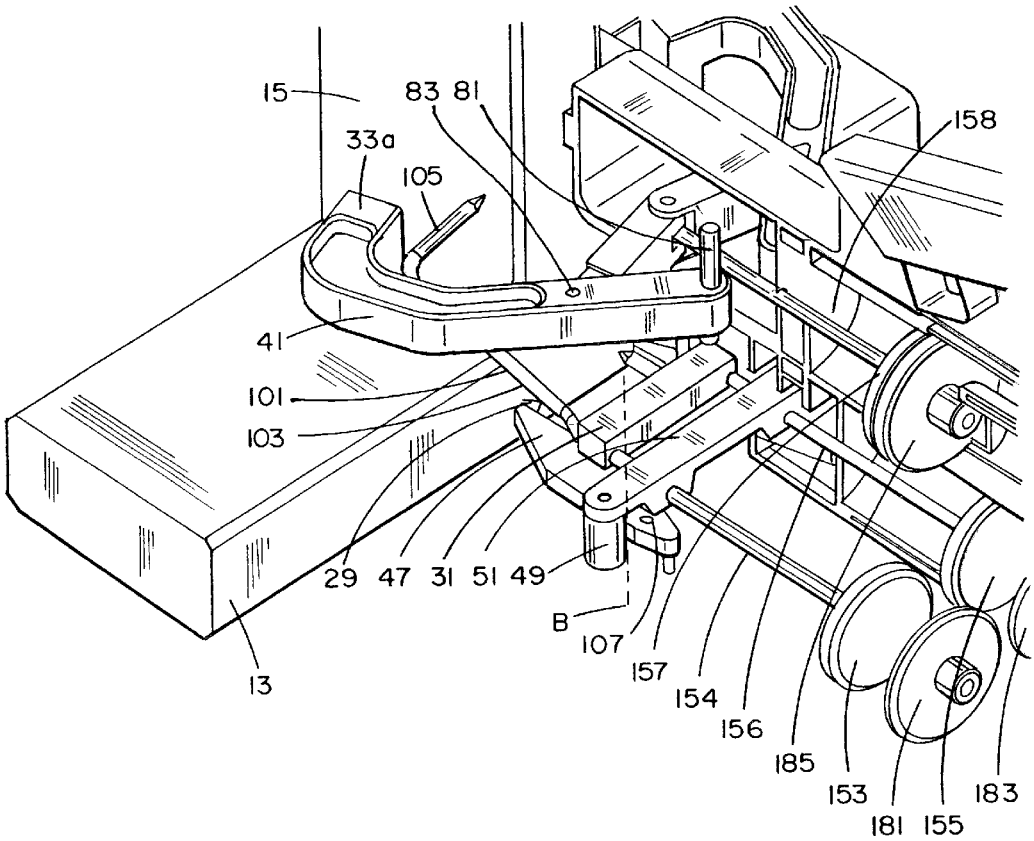
FIG. 3 is a view similar to that of FIG. 2 showing the tool in position for being used to secure two members, i.e., beams, posts, planks or timbers, together.
Figure 4:
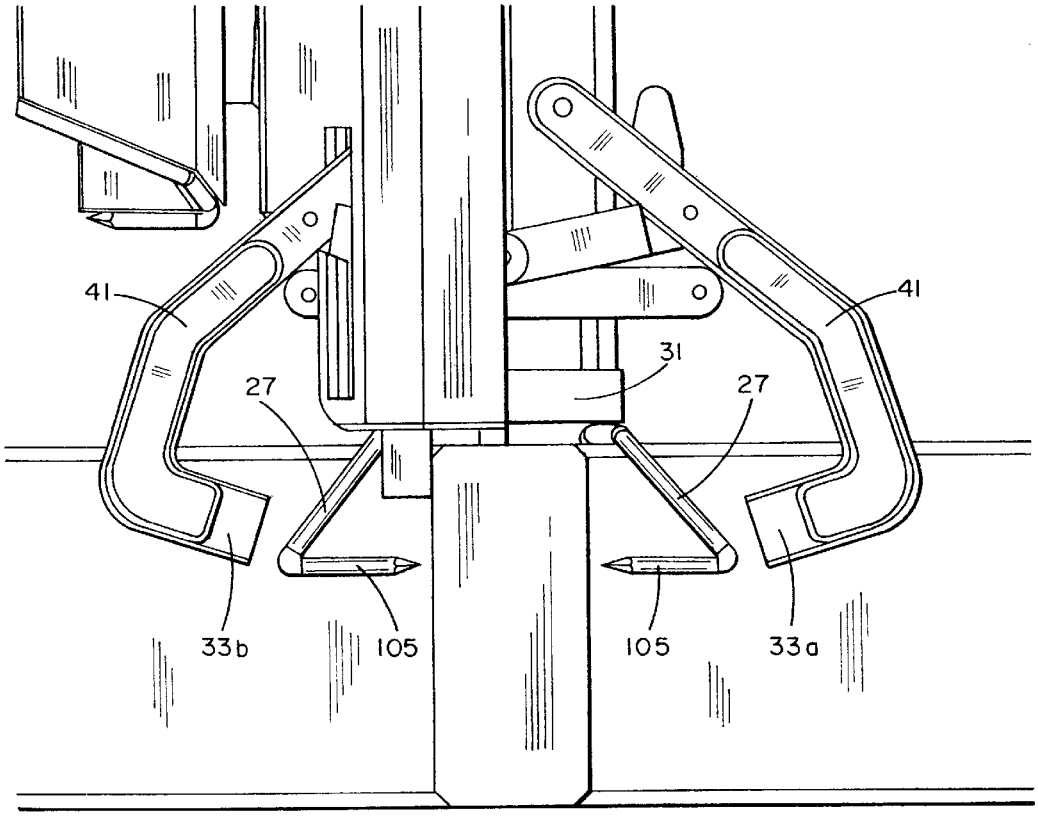
FIG. 4 is a top partial cutaway view of the tool in abutment with two members, i.e., timbers or beams to be secured together, after having driven the first spikes of the connectors, but prior to driving of the second spikes of the connectors into the members.
Figure 5:
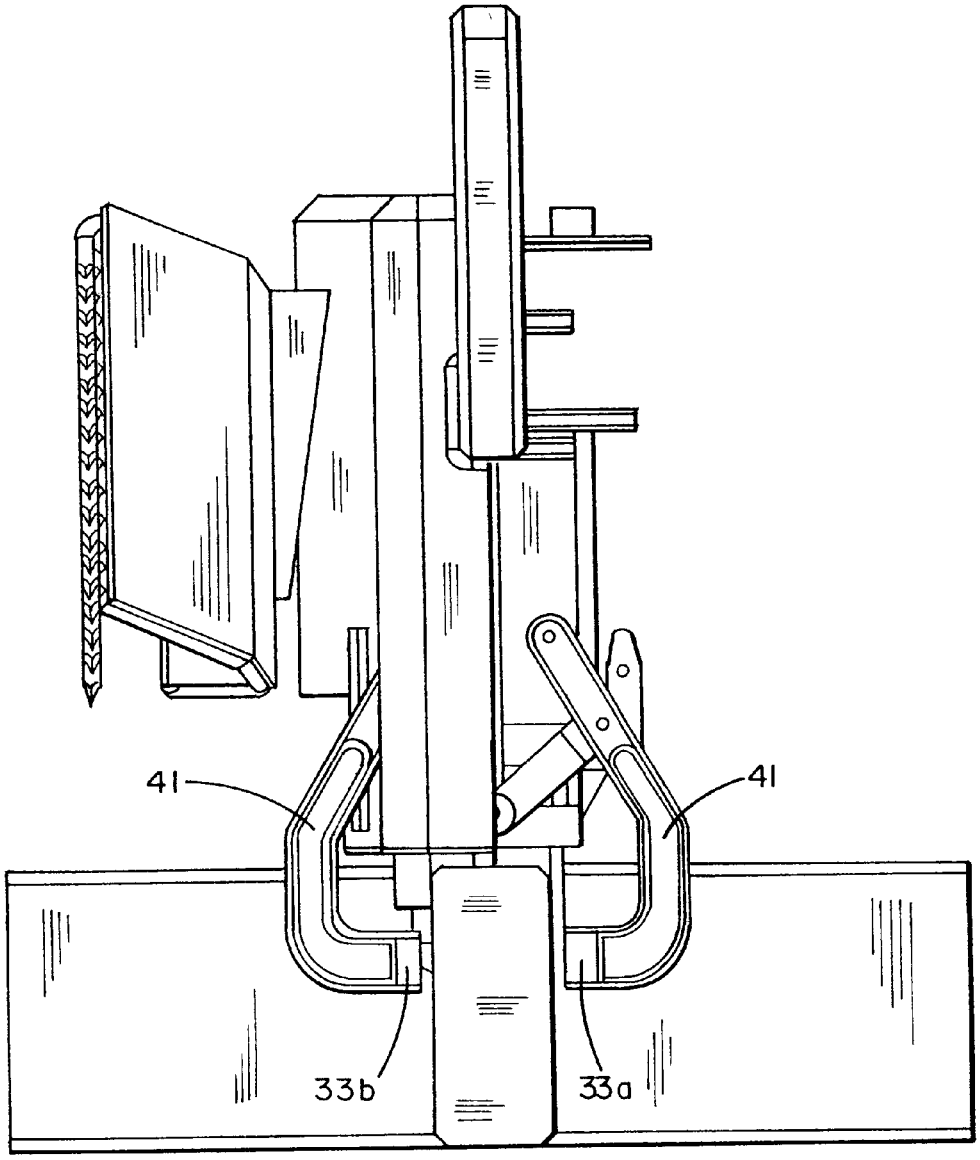
FIG. 5 is a view similar to that of FIG. 4 showing the tool after having driven the second spikes of the connectors into the respective structural members for securing them together.

The positioning holders are made up of swing arms 47 and include a ledge at its outward tip 29 for engaging and supporting the spiked end 103 of each connector 27. The swing arms 47 are positioned for having each connector 27 fed from the connector holding trays 25*a* and 25*b* when it is in a first position as shown in FIGS. 1 and 2, to a second position as shown in FIG. 3 to have the first spiked ends 103 of the connector 27, aligned for being driven into the first structural member 13 by impact block 31, making up a first connector drive member, for forcing the spike 103 of the connectors 27 into the structural member 13. Once spiked end 103 of connector 27 has been driven into the first structural member 13, swing arms 41 having press hands 33*a* and 33*b* making up second connector driving members, and located substantially about the position of the second spiked ends 105 of connectors 27, are rotated rapidly in a hammering action to drive the spiked ends 105 into the second structural member 15, as is more clearly shown in FIGS. 4 and 5.

Figure 6:
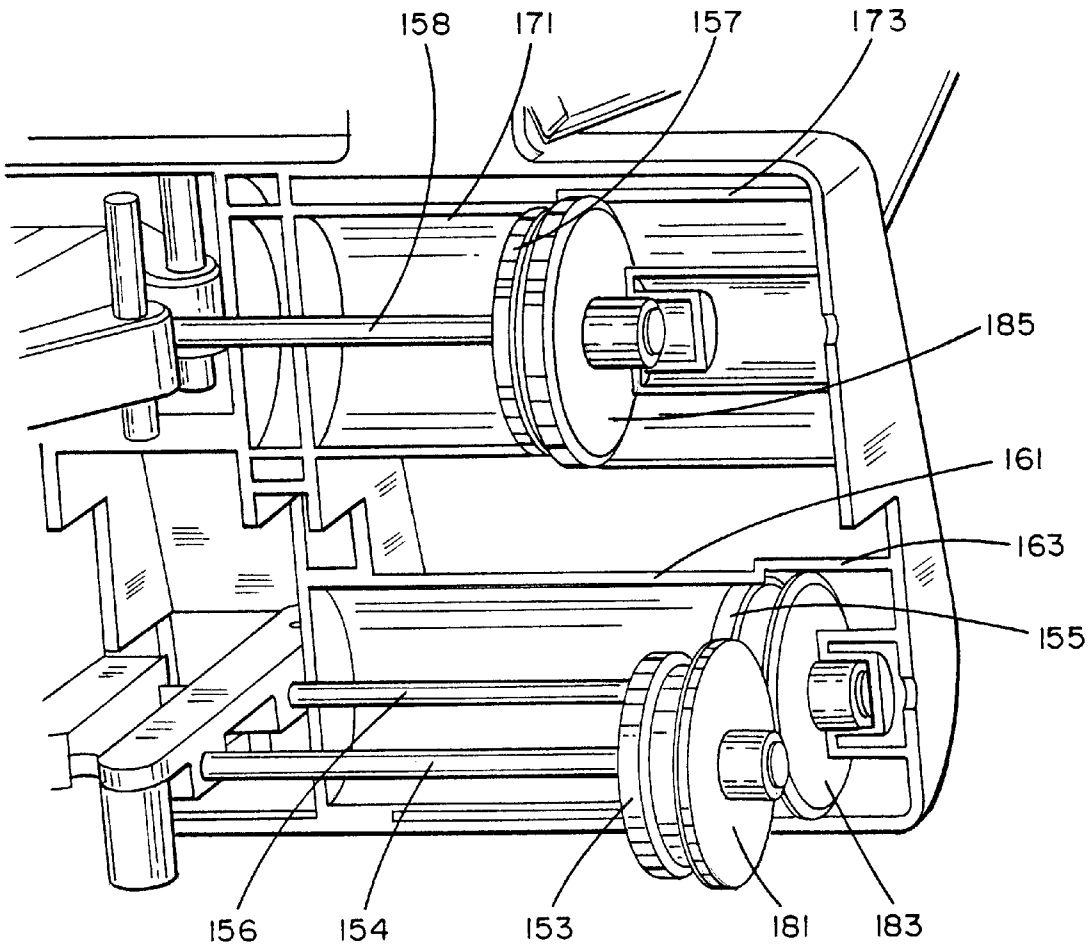
FIG. 6 is a partial cross section view of the cylinder drive mechanism showing multiple cylinder pairs with poppet valve arrangements.

To force the various parts of the tool 11 to move, the tool 11 includes a drive mechanism, as is more clearly shown in FIGS. 2, 3 and 6. The drive mechanism includes at a lower portion four cylinders. There is shown a cylinder 161 for a piston 155, and one not shown for a piston 153. In addition, a cylinder 163 is shown for poppet valve 183, and another is provided (not shown) for poppet valve 181. Cylinders 161 and 163, and those not shown, have their axes lying in a certain horizontal plane A. The axis of another two cylinders 171 and 173 are offset from the plane of, and equidistant from the aforementioned cylinders in plane A. Each of the cylinders has a constant inner diameter. However, the diameter of the primary and secondary sealing poppets are larger than the corresponding drive cylinders in order to allow controlled motion of the poppets. As apparent from FIG. 6, the drive cylinders and the poppet cylinders are not one continuous cylinder, and are separate cylinders, making up cylinder pairs.

The side and end walls of each cylinder, not shown, are made of appropriate material and thickness to withstand millions of cyclic changes in internal air pressure, typically, between zero and 120 p.s.i. gauge. The inner surface of each side wall, not shown, is made smooth to minimize air leakage and wear between the wall and a sealing O-ring within each cylinder 61*a*, 61*b* and 71.

Within each cylinder is a piston assembly 153, 155 and 157. The cylinders in Plane A are known generally as first stage cylinders, and include first stage drive pistons 154 and 156 and primary sealing poppets 181 and 183 shown in open position in FIG. 6. In what is known as the second stage cylinder 173 there is a second-stage drive piston 157 and a sealing poppet 185 (shown closed in FIG. 6). The sealing poppets 181, 183 and 185 are of larger diameter than the drive pistons 153, 155 and 157 and they reside in their own cylinders.

Appropriate sealing springs, not shown, and circumferential O-ring seals, also not shown, are provided for the sealing poppets 181, 183 and 185 in a manner which is conventional and will be readily apparent to those of ordinary skill in the art. Each sealing spring is in compression behind the respective sealing poppets 181, 183 and 185. The forward portion of each drive piston 153, 155 and 157 terminates respectively in drive rods 154, 156 and 158, which extend through a hole in the forward end of its respective cylinder. It should be noted that the use of drive pistons and sealing poppets in smooth-bored cylinders with two distinct diameters is common in the prior art of pneumatic nailers, of a type, for example, as is disclosed in U.S. Pat. No. 4,197,974.

As also previously noted, the tool 11 includes two sets of connector holders 25*a* and 25*b*, which define guide rails made up of upper plates 43 and 45, for holding left-hand connectors and right-hand connectors respectively. In each package, the connectors 27 are arranged such that the first spiked end 103 of each connector points outboard of the tool 11. Each connector 27 in each package is stacked slightly above and behind the connector 27 in front of it, and the second spike 105 of each connector 27 lies in a common vertical plane. This configuration allows a supply of connectors 27 to be compactly stored within the plates 43 and 45 along and up the lateral sides 23 of the tool 11.

The tool 11 includes two swing arms 47 which make up the connector positioning holders, and which are rotatably pinned through vertical axes B (FIG. 3). The two axes on each side of the tool 11 are fixed relative to the body 17 of the tool 11. The tool also includes a pair of swing arms springs (not shown) which bias the swing arms 47 into the position, i.e., a first position, as shown on FIGS. 1 and 2.

One end of each spring is attached to each swing arm 47 inboard of respective pivot points 107, as shown in FIG. 3, with the opposite end of each spring fixed to the body 17 of the tool 11. If a tension spring is used, it is fixed to the body of the tool 11 forward of the pivot point 107. In this manner, the spring imposes a torque on the swing arm 47 that tends to move the outboard tip or support 29 of the swing arm 47 backwards. If a compression swing is used, it is fixed to the body of the tool 11 backward of the pivot point, so that the outboard tip or support 29 of the swing arm 47 which supports the spiked end 103 of each connector 27, tends to move the swing arm backward.

The tool 11 includes an engagement block 51 as shown in FIG. 2 that is external to the cylinders but rigidly attached to the forward ends of drive rods 154 and 156. At each lateral end of each engagement block 51 is a vertical boss 49 that acts as a cam. The bosses 49 are located so that as drive rods 154 and 156, and engagement block 51 move forward, each boss 49, making up a cam, contacts a swing arm 47 outboard of its respective pivot point 107. The drive rods 154 and 156 are driven with enough force to overcome the spring force and cause the swing arms 47 to rotate so that the outboard tips 29 supporting the first spiked ends 103 of connectors 27 move forward.

This motion of the swing arms 47 will rotate the next connector 27 from each feed package about ninety degrees so that the axis of the first spike 103 is normal to the front face of structural member 13 and ready to be driven forward. The surface of the swing arm 47 that contacts the boss 49 making up the cam is shaped so that once the desired location is achieved, further forward motion of the engagement block 51 and cam does not cause additional rotation of the arms 47.

As shown in FIGS. 2 and 3, the tool 11 also includes an impact block 31 which can be an extension of engagement block 51 and that is rigidly fixed relative to the first-stage drive rods 154 and 156. After the swing arms 47 have moved the connectors 27 into position to be driven, the continued forward motion of the drive rods 154 and 156 impact block 31 to drive the first spikes 103 of the connectors into the first structural member 13, as is more clearly shown in FIGS. 3 and 4. The stroke length of the drive rods 154 and 156 is set such that it is sufficient to drive the first spikes 103 fully into the structural member 13.

As may be further appreciated, the tool 11 can be adjusted or adapted to drive connectors into double-plate assemblies (as opposed to single-plate assemblies shown in the drawings where structural member 13 is a plate). Such connectors are of the type, for example, disclosed in FIGS. 5*a* and 5*b* of U.S. Pat. No. 5,466,087, and appropriate adaptation and modification of the tool to accommodate such connectors will be readily apparent to those of ordinary skill in the art from a reading of the description herein as well as with knowledge of the types of connectors referred to.

While for driving the first spikes 103, two drive rods 154 and 156 are shown, it is possible to generate from a single cylinder and a single drive rod the force required to drive the first spike ends 103.

FIGS. 1, 2, 3 4, and 5 show that the tool 11 also includes two swing arms 41 which are rotatably pinned through vertical axes 81. The two axes 81 are fixed relative to the body 23 of the tool 11. The swing arms 41 terminate in press hands 33*a* and 33*b*. The vertical location of the center of each hand 33*a* and 33*b* is positioned such as to roughly match the location of the second spike 105 of the respective left-hand or right-hand connector 27 when it is ready to be driven. Each swing arm 41 is pinned to a toggle mechanism 79 and 83 which in turn is attached to the forward end of the drive rod 158. Forward movement of drive rod 75 acts through the toggle mechanism 79 and 83 to cause the swing arms 41 to rotate, moving the press hands 33*a* and 33*b* inward. The hands 33*a* and 33*b* drive the respective second spikes 105 into the structural member 15. The stroke length of drive rod 158 is sufficient to drive the second spikes 105 fully into the structural member 15.

With respect to the pneumatic drive mechanism for operating the tool 11, it will be appreciated that other drive mechanisms can be substituted such as electric or gas powered motor drives, as will be readily apparent to those of ordinary skill in the art.

Having thus generally described the invention, the same will become better understood from the appended claims in which it is set forth in a non-limiting manner.

What is claimed is:

1. A connector insertion tool for connecting two structural members to each other, with connectors having a cranked stem and a spike at each end, comprising:

a first positioning holder for supporting a first spiked end of a connector of the type having a cranked stem and first and second spiked ends, in a first position in which the first spiked end is not in a position to be driven into a first structural member, and said first positioning holder movable to a second position in which the first spiked end is positioned in a position for being driven into a first structural member;

a first drive member movable from a first position to a second position for driving the first spiked end into a first structural member when said first spiked end is positioned for being driven into a first structural member, a second drive member movable from a first position to a second position for driving the second spiked end into a second structural member when said second spiked end is positioned for being driven into a second structural member; and a drive mechanism for moving the first drive member between said first and second position, and for moving the second drive member between said first and second position, whereby when said first spiked end is driven into a first structural member and second spiked end is driven into a second structural member, a first and a second structural member are secured together.

2. The connector insertion tool of claim 1, further comprising a grip and trigger assembly for allowing a user to precisely position the tool for driving said connectors into a first structural member and a second structural member, and for actuating the driving of said connectors into a first structural member and a second structural member.

3. The connector insertion tool of claim 2 wherein said grip and trigger assembly is rotatable relative to said connector tool to allow use at floor level at a user's feet or overhead.

4. The connector insertion tool of claim 1, further comprising a first connector support member for supporting a plurality of said connectors laterally disposed relative to said connector tool in position for being removed therefrom by said first positioning holder.

5. The connector insertion tool of claim 1 further comprising:

a first connector support member for supporting a plurality of said connectors laterally disposed relative to said insertion tool in position for being removed therefrom by said first positioning holder; and a second connector support member for supporting a plurality of said connectors laterally disposed relative to said insertion tool, on a side opposite said first connector support member, in position for being removed therefrom by said second positioning holder.

6. The connector insertion tool of claim 1 wherein said drive mechanism is also configured for moving said first positioning holder into said second position.

7. The connector insertion tool of claim 1 wherein said drive mechanism comprises a piston assembly having drive rods for driving said first and second drive members into said second position.

8. The connector insertion tool of claim 1, wherein said first positioning holder comprises a swing arm rotatably pinned through a vertical axis which is fixed relative to the tool, and a spring connected to said swing arm to urge the swing arm into said first position.

9. The connector insertion tool of claim 8, wherein said drive mechanism comprises an assembly of drive rods for driving said first and second drive members, and vertically extending bosses for contacting said swing arms and rotating said swing arms into said second position as said drive rods drive said first and second drive members.

10. The connector insertion tool of claim 1, wherein said first positioning holder is configured for supporting each connector in a first position in which the first spiked end is not substantially perpendicular to a first structural member, and is movable to a second position in which the first spiked end is positioned substantially perpendicular to a first structural member into which said first spiked end is to be driven, and the second spiked end is positioned substantially perpendicular to a second structural member abutting a first structural member in a position substantially perpendicular thereto.

11. The connector insertion tool of claim 10, further comprising a second positioning holder disposed parallel to said first positioning holder for a first spiked end of a connector of the type having a cranked stem and first and second spiked ends, in a first position in which the spiked end is not substantially perpendicular to a first structural member into which it is to be driven, and said second positioning holder movable to a second position in which the first spiked end is positioned substantially perpendicular to a first structural member on a side of the tool opposite the connector supported by the first positioning holder, and with the respective first spiked ends offset relative to each other to avoid interference when driven into a first structural member.

12. The connector insertion tool of claim 11, wherein said first drive member is positioned for driving the first spiked end of a connector supported by said first positioning holder and the first spiked end of a connector supported by said second positioning holder substantially simultaneously.

13. A connector insertion tool for connecting two structural members to each other, with connectors having a cranked stem and a spike at each end, comprising:

a first positioning holder for supporting a first spiked end of a connector of the type having a cranked stem and first and second spiked ends, in a first position in which the first spiked end is not in a position for being driven into a first structural member, and said first positioning holder movable to a second position in which a first spiked end is positioned in a position for being driven into the first structural member, and the second spiked end is positioned substantially perpendicular to a second structural member abutting a first structural member;

a second positioning holder disposed parallel to said first positioning holder for supporting a first spiked end of a connector of the type having a cranked stem and first and second spiked ends, in a first position in which the spiked end is not in a position for being driven into a first structural member, and said second positioning holder being movable to a second position in which the first spiked end is positioned in a position for being driven into a first structural member on a side of the tool opposite the connector supported by said first positioning holder, and the second spiked end is positioned substantially perpendicular to a second structural member abutting a first structural member;

a first drive member movable from a first position to a second position for driving the first spiked ends into a first structural member when said first spiked ends are positioned for being driven thereinto, and said first drive member is positioned for driving the first spiked end of a connector supported by said first positioning holder and the first spiked end of a connector supported by said second positioning holder substantially simultaneously;

a second drive member movable from a first position to a second position for driving the second spiked ends into a second structural member when said second spiked ends are positioned for being driven thereinto, and said second drive member is positioned for driving the second spiked end of a connector supported by said first positioning holder and the second spiked end of a connector supported by said second positioning holder substantially simultaneously; and a drive mechanism for moving the first drive member between said first and second position, and for moving the second drive member between said first and second position, whereby when said first spiked ends are driven into a first structural member and second spiked ends are driven into a second structural member, the structural members are secured together.

14. The connector insertion tool of claim 13, further comprising a grip and trigger for allowing a user to precisely position the tool for driving said connectors into a first structural member and a second structural member, and for actuating the driving of said connectors into a first structural member and a second structural member.

15. A connector insertion tool for connecting two structural members to each other, with connectors having a cranked stem and a spike at each end, comprising:

a first positioning holder for supporting a first spiked end of a first connector of the type having a cranked stem and first and second spiked ends, in a first position in which the first spiked end is not in a position to be driven into a first structural member, and said first positioning holder movable to a second position in which the first spiked end is positioned in a position for being driven into a first structural member;

a second positioning holder disposed substantially parallel to said first positioning holder for supporting a first spiked end of a second connector of the type having a cranked stem and first and second spiked ends, in a first position in which the first spiked end is not in a position to be driven into a first structural member, and said second positioning holder movable to a second position in which the first spiked end is positioned in a position for being driven into a first structural member on a side of the tool opposite a first connector supported by said first positioning holder, and with the respective first spiked ends of a first connector and a second connector offset relative to each other;

first drive means movable from a first position to a second position for driving the first spiked ends of respective first and second connectors from positions opposite to each other relative to sides of the tool into a first structural member when said first spiked ends are positioned for being driven into a first structural member;

second drive means movable from a first position to a second position for driving the second spiked ends of respective first and second connectors into a second structural member when said first spiked ends are driven into a first structural member and the second spiked ends are driven into a second structural member; and a drive mechanism for moving the first drive means between said first and second position, and for moving the second drive means between said first and second position, whereby when said first spiked ends are driven into a first structural member and said second spiked ends are driven into a second structural member, a first structural member and a second structural member are secured together.

16. The connector insertion tool of claim 15, wherein said first drive member is positioned for driving the first spiked end of a connector supported by said first positioning holder and the first spiked end of a connector supported by said second positioning holder substantially simultaneously.

17. The connector insertion tool of claim 15 wherein said drive mechanism is also configured for moving said first and second positioning holders into said second position.

18. The connector insertion tool of claim 15 wherein said drive mechanism comprises a piston assembly having drive rods for driving said first and second drive members into said second position.

19. The connector insertion tool of claim 15, wherein said first and second positioning holders each respectively comprise a swing arm rotatably pinned through a vertical axis which is fixed relative to the tool, the respective swing arms located on opposite sides of the insertion tool relative to each other, and a spring connected to each swing arm to urge the respective swing arm into said first position.

20. The connector insertion tool of claim 19 wherein said drive mechanism comprises an assembly of drive rods for driving said first and second drive members, and vertically extended bosses for contacting said swing arms and rotating said swing arms into said second position as said drive rods drive said first and second drive members.

21. The connector insertion tool of claim 15, further comprising a grip and trigger assembly for allowing a user to precisely position the tool for driving said connectors into a first structural member and a second structural member, and for actuating the driving of said connectors into a first structural member and a second structural member.

22. The connector insertion tool of claim 21 wherein said grip and trigger assembly is rotatable relative to said connector tool to allow use at floor level at a user's feet or overhead.

23. The connector insertion tool of claim 15, further comprising a first connector support member for supporting a plurality of said connectors laterally disposed relative to said connector tool in position for being removed therefrom by said first positioning holder.

24. The connector insertion tool of claim 15 further comprising:

a first connector support member for supporting a plurality of said connectors laterally disposed relative to said insertion tool in position for being removed therefrom by said first positioning holder; and a second connector support member for supporting a plurality of said connectors laterally disposed relative to said insertion tool, on a side opposite said first connector support member, in position for being removed therefrom by said second positioning holder.

25. The connector insertion tool of claim 15 wherein said drive mechanism is also configured for moving said first positioning holder into said second position.

26. The connector insertion tool of claim 15 wherein said drive mechanism comprises a piston assembly having drive rods for driving said first and second drive members into said second position.

27. The connector insertion tool of claim 15, wherein said first positioning holder comprises a swing arm rotatably pinned through a vertical axis which is fixed relative to the tool, and a spring connected to said swing arm to urge the swing arm into said first position.

28. The connector insertion tool of claim 27, wherein said drive mechanism comprises an assembly of drive rods for driving said first and second drive means, and vertically extending bosses for contacting said swing arms and rotating said swing arms into said second position as said drive rods drive said first and second drive means.

29. The connector insertion tool of claim 28, wherein said drive mechanism comprises an assembly of drive rods for driving said first and second drive means, and vertically extended bosses for contacting said swing arms and rotating said swing arms into said second position as said drive rods drive said first and second drive means.

30. The connector insertion tool of claim 15, wherein said first positioning holder is configured for supporting each connector in a first position in which the first spiked end is not substantially perpendicular to a first structural member, and is movable to a second position in which the first spiked end is positioned substantially perpendicular to a first structural member into which said first spiked end is to be driven, and the second spiked end is positioned substantially perpendicular to a second structural member abutting a first structural member in a position substantially perpendicular thereto.

31. The connector insertion tool of claim 30, further comprising a second positioning holder disposed parallel to said first positioning holder for a first spiked end of a connector of the type having a cranked stem and first and second spiked ends, in a first position in which the spiked end is not substantially perpendicular to a first structural member into which it is to be driven, and said second positioning holder movable to a second position in which the first spiked end is positioned substantially perpendicular to a first structural member on a side of the tool opposite the connector supported by the first positioning holder, and with the respective first spiked ends offset relative to each other to avoid interference when driven into a first structural member.

32. The connector insertion tool of claim 31, wherein said first drive member is positioned for driving the first spiked end of a connector supported by said first positioning holder and the first spiked end of a connector supported by said second positioning holder substantially simultaneously.

* * * * *